US005238482A

United States Patent [19]

Stasko et al.

[11] Patent Number: 5,238,482

[45] Date of Patent: Aug. 24, 1993

[54] PREALLOYED HIGH-VANADIUM, COLD WORK TOOL STEEL PARTICLES AND METHODS FOR PRODUCING THE SAME

[75] Inventors: William Stasko, West Homestead; Kenneth E. Pinnow, Pittsburgh, both of Pa.

[73] Assignee: Crucible Materials Corporation, Syracuse, N.Y.

[21] Appl. No.: 704,082

[22] Filed: May 22, 1991

[51] Int. Cl.[5] ..... B22F 9/08

[52] U.S. Cl. ..... 75/338; 75/355; 75/956

[58] Field of Search ..... 75/338, 339, 352, 355, 75/950, 956

[56] References Cited

U.S. PATENT DOCUMENTS

| | | |
|---|---|---|
| 3,556,780 | 1/1971 | Holtz, Jr. . |
| 3,746,518 | 7/1973 | Holtz, Jr. . |
| 4,032,302 | 6/1977 | Nakamura et al. . |
| 4,113,920 | 9/1978 | Helton et al. . |
| 4,249,945 | 2/1981 | Haswell et al. . |
| 4,469,514 | 9/1984 | Holtz, Jr. . |
| 4,534,917 | 8/1985 | Walz . |
| 4,576,642 | 3/1986 | Holtz, Jr. . |
| 4,765,836 | 8/1988 | Hauser et al. . |
| 4,818,283 | 4/1989 | Grunthaler et al. . |
| 4,822,267 | 4/1989 | Walz . |
| 4,863,515 | 9/1989 | Roberts et al. . |
| 4,880,461 | 11/1989 | Uchida . |
| 4,919,854 | 4/1990 | Walz . |
| 4,936,911 | 6/1990 | Roberts et al. . |

FOREIGN PATENT DOCUMENTS

| | | |
|---|---|---|
| 74.10174 | 10/1974 | France . |
| 77.03421 | 9/1978 | France . |
| 60-204868 | 10/1985 | Japan . |
| 1593695 | 1/1981 | United Kingdom . |

OTHER PUBLICATIONS

World Patents Indext Latest, Derwent Publications Ltd., AN 77-27737Y and JP-A-50 094 008, Jul. 26, 1975.

English language translation of European Patent Document No. 387,237, dated Sep. 12, 1990, Hribernik et al.

English language translation of European Patent Document No. 322,397, dated Jun. 28, 1989, Hribernik et al.

"Microstructures and Mechanical Properties of Sintered and Hot-Forged High-Carbon High-Vanadium Tool Steels", Ando et al., Sep. 11, 1975, pp. 2629-2638.

*Primary Examiner*—George Wyszomierski

*Attorney, Agent, or Firm*—Finnegan, Henderson, Farabow, Garrett & Dunner

[57] ABSTRACT

Prealloyed high-vanadium, cold work tool steel particles are provided for use in the powder-metallurgy production of tool steel articles. The particles are of a cold work tool steel alloy having an MC-type vanadium carbide dispersion of a carbide particle size substantially entirely less than 6 microns and in an amount of 18.5 to 34.0% by volume. The particles are produced by atomizing a molten tool steel alloy at a temperature above 2910° F. and rapidly cooling the atomized alloy to form solidified particles therefrom. The particles have the MC-type vanadium carbide dispersion therein.

24 Claims, 3 Drawing Sheets

PREALLOYED HIGH-VANADIUM, COLD WORK TOOL STEEL PARTICLES AND METHODS FOR PRODUCING THE SAME

BACKGROUND OF THE INVENTION

1. Field of the Invention

The invention relates to prealloyed high-vanadium, cold work tool steel particles for use in the powder-metallurgy production of cold work tool steel articles and to a method for producing these particles.

2. Description of the Prior Art

In various high-vanadium cold work tool steel applications, high wear resistance in combination with good grindability, strength and toughness are required. U.S. Pat. No. 4,249,945 discloses tool steel articles made by powder- metallurgy techniques using alloys such as AISI A-11. These articles are made in the conventional manner from compacted, prealloyed particles that contain relatively large volumes of MC-type vanadium carbides to provide improved wear resistance. These articles exhibit a good combination of wear resistance, toughness and strength; however, for some applications the wear resistance is not adequate.

In alloys of this type, it is known that the wear resistance may be increased by increasing the MC-type vanadium carbide content. MC-type vanadium carbide is particularly useful for this purpose because its hardness (microhardness of 2800 Kg/mm$^2$) is greater than that of most other metallic carbides such as columbium carbide (microhardness of 2400 Kg/mm$^2$), tantalum carbide (microhardness of 1800 Kg/mm$^2$) and chromium carbide (microhardness of 1300 Kg/mm$^2$). Increases in vanadium carbide content, however, typically result in degradation with respect to toughness. Specifically, it is generally accepted that vanadium contents of over 11% by weight result in degradation of toughness to levels unacceptable for many tool steel applications. Specifically in this regard, with vanadium contents in excess of 11%, the resulting size and dispersion of the MC-type vanadium carbides in the microstructure of the alloy detrimentally affects grindability, as well as toughness, of the alloy. Grindability is an important property of these alloys, because grinding is a necessary operation in producing final products, such as work rolls, punches, dies, plastic molds, slitter knives, plastic extrusion barrels, pump components and the like.

SUMMARY OF THE INVENTION

It is accordingly a primary object of the present invention to provide prealloyed high-vanadium cold work tool steel particles for use in powder-metallurgy production of cold work tool steel articles wherein amounts of MC-type vanadium carbides may be present as a dispersion in the alloy matrix in amounts greater than heretofore possible to achieve improved wear resistance, while retaining sufficient toughness and grindability.

An additional object in the invention is to provide a method for producing prealloyed cold work tool steel particles by atomization wherein control of the atomization process in accordance with the invention enables higher than conventional amounts of vanadium and MC-type vanadium carbides to be present in the resulting atomized particles to achieve improved wear resistance while maintaining toughness and grindability at accepted commercial limits.

In accordance with the invention, the prealloyed cold work tool steel particles thereof for use in the powder-metallurgy production of cold work tool steel articles comprise a cold work tool steel alloy having an MC-type vanadium carbide dispersion of a carbide particle size substantially entirely less than 6 microns and in an amount of about 18.5 to 34.0% by volume. Preferably, the carbide particle size is substantially entirely less than 4 microns.

The particles are preferably gas-atomized, spherical particles.

The alloy composition of the particles may be as follows:

| Element | Broad | Preferred | Most Preferred |
|---|---|---|---|
| Manganese | 0.2 to 2.0 | 0.2 to 1.0 | 0.2 to 1.0 |
| Silicon | 2.0 Max | 2.0 Max | 2.0 Max |
| Chromium | 1.5 to 6.0 | 4.0 to 6.0 | 4.5 to 5.5 |
| Molybdenum | Up to 6.0 | 0.5 to 2.0 | 0.5 to 2.0 |
| Sulfur | 0.30 Max | 0.10 Max | 0.10 Max |
| Phosphorus | 0.10 Max | 0.06 Max | 0.06 Max |
| Vanadium | 11.5 to 20.0 | 12.0 to 18.0 | 12.0 to 16.0 |
| Carbon* | 2.6 to 4.70 | 2.7 to 4.30 | 2.7 to 3.90 |
| Nitrogen* | 0.15 Max | 0.15 Max | 0.15 Max |
| Iron** | Balance | Balance | Balance |

*$(C + N)_{min} = 0.30 + 0.2$ (% V)
$(C + N)_{max} = 0.70 + 0.2$ (% V)
**Includes incidental elements and impurities characteristic of steelmaking practice.

In accordance with the method of the invention the prealloyed tool steel particles thereof are produced by atomizing a molten cold work tool steel alloy, which may be of the above-listed compositions, at a temperature above 2910° F. and rapidly cooling the atomized alloy to form solidified particles therefrom. The particles have an MC-type vanadium carbide dispersion therein of a carbide particle size substantially entirely less than 6 microns and in an amount of 18.5 to 34.0% by volume.

Preferably, the atomization temperature is above 2910° F. to about 3250° F. More preferably, this temperature may be above 2910° F. to about 3020° F., or about 2950° F. to about 3250° F.

Preferably, atomization is performed by the use of gas atomization.

It has been determined in accordance with the invention, as will be demonstrated by the data and specific examples thereof reported hereinafter, that by using higher than normal atomization or super heating temperatures with respect to the alloy during atomization thereof it is possible to produce atomized, and particularly gas atomized, cold work tool steel powders containing 11% or more vanadium with smaller MC-type vanadium carbides than can be obtained by prior art practices. Consequently, in accordance with the invention it is possible to produce atomized tool steel powders and tool steel articles therefrom having greatly improved combinations of wear resistance, grindability and toughness. The improved wear resistance results from the increased MC-type vanadium carbide content with the grindability and toughness resulting from these carbides being in a dispersion that is of finer carbide particle size than conventionally achieved at these high contents. In addition, the carbide dispersion in accordance with the invention is substantially more uniform and spherical than was conventionally obtainable at these high carbide contents.

The powder-metallurgy tool steel articles which may be produced from the prealloyed powders in accordance with the invention are compacted using any of the well known powder metallurgy practices employing a combination of heat and pressure at temperatures below the melting point of the powder particles to form a coherent mass thereof having a density in excess of 99% of theoretical density. These practices include both sintering and hot isostatic compacting in a gas pressure vessel. These articles may include products such as billets, blooms, rod, bar and the like, as well as final products, such as rolls, punches, dies and the like, which may be fabricated from the aforementioned intermediate product forms. Composite articles may also be produced wherein the powder particles in accordance with the invention are clad or joined to a substrate by various practices, which may include hot isostatic compaction and extrusion.

It is significant with respect to the invention to balance both the carbon and nitrogen contents of the alloy, as opposed to carbon alone, with respect to the ferrite forming elements thereof, such as silicon, chromium, vanadium, and molybdenum, to avoid the formation of high temperature (delta) ferrite in the microstructure. Delta ferrite adversely affects the hot workability of the alloy and lowers the attainable hardness thereof. It is further significant to have sufficient carbon and nitrogen present for purposes of combining with the vanadium to form MC-type vanadium carbides and to achieve a hardness of at least 56 Rockwell C (HRC) in the heat treated condition. However, this does not preclude use of the product of this invention at lower hardnesses. To achieve this, without producing unduly large amounts of retained austenite in the article after heat treatment, the carbon and nitrogen are balanced with the vanadium present in the alloy in accordance with the following formulas:

$$Percent\ (C+N)minimum = 0.30 + 0.20\ (\%\ V)$$

$$Percent\ (C+N)maximum = 0.70 + 0.20\ (\%\ V)$$

It is preferable in accordance with the invention to control the amounts of vanadium and the other alloying elements of the prealloyed powders and of the articles made therefrom within the above-indicated ranges to obtain the desired improvement and wear resistance, along with adequate hardenability , hardness, machinability, and grindability.

Vanadium is important from the standpoint of increasing the wear resistance through the formation of MC-type vanadium carbides in amounts greater than previously obtainable in accordance with prior art practice.

Manganese is present to achieve hardenability and also improves machinability through the formation of manganese sulfides. Excessive amounts of manganese, however, lead to the formation of unduly large amounts of retained austenite during heat treatment and increase the difficulty of annealing the articles made from the particles of the invention to the low hardnesses needed for good machinability.

Silicon is useful for improving tempering resistance at elevated temperatures and for improving oxidation resistance; however, excessive amounts of silicon impair the machinability of the articles made from the particles of the invention when in the annealed condition.

Chromium is important for achieving adequate hardenability and for increasing the tempering resistance of articles at elevated temperatures. Excessive amounts of chromium, however, result in the formation of high temperature (delta) ferrite which adversely affects hot workability and obtainable hardness. In addition, excessive chromium may result in the formation of carbides, other than vanadium carbides, which are not as effective as vanadium carbides for increasing wear resistance.

Molybdenum, like chromium, increases the hardenability and tempering resistance of the articles.

Sulfur is useful to improve machinability through the formation of manganese sulfides. If present in excessive amounts, however, sulfur will reduce hot workability.

The alloys for atomization in accordance with the invention may be melted by a variety of practices, but most preferably are melted by air or vacuum induction melting techniques. The temperatures used in atomizing the alloy are critical to the method of the invention from the standpoint of achieving the fine carbide size necessary to achieve the desired improvement in toughness and grindability while maintaining higher than conventional contents of these carbides to achieve the desired improved wear resistance.

DESCRIPTION OF THE PREFERRED EMBODIMENTS

By way of demonstration of the invention, a series of alloys were produced by induction melting and were then nitrogen atomized at various temperatures. The chemical compositions, in percent by weight, and the atomizing temperatures of these alloys are set forth in Table I. Alloy All is an alloy having a conventional vanadium content and MC-vanadium carbide content. The calculated volume of the MC-type vanadium carbide for each alloy is also included in this table.

TABLE I

Chemical Composition Atomization Temperatures of High Vanadium Wear Resistant PM Tool Steels

| Grade | Heat | Atomization Temperature | Volume Percent MC-Type Vanadium Carbide | C | Mn | P | S | Si | Cr | Mo | V | N |
|---|---|---|---|---|---|---|---|---|---|---|---|---|
| A-11* | P67216 | 2850° F. | 16.8 | 2.40 | 0.45 | 0.014 | 0.080 | 0.86 | 5.25 | 1.26 | 9.85 | 0.078 |
| CPM 15V | 516-401 | 2910° F. | 25.2 | 3.49 | 0.50 | 0.024 | 0.066 | 0.90 | 4.83 | 1.32 | 14.76 | 0.120 |
| CPM 15V | 518-277 | 3015° F. | 25.9 | 3.55 | 1.11 | — | 0.013 | 0.69 | 4.64 | 1.29 | 15.21 | 0.040 |
| CPM 15V | 518-306 | 3020° F. | 27.1 | 3.59 | 0.58 | 0.013 | 0.008 | 1.40 | 4.91 | 1.34 | 15.91 | 0.058 |
| CPM 18V | 518-308 | 3050° F. | 29.5 | 3.98 | 0.60 | 0.013 | 0.010 | 1.32 | 4.85 | 1.36 | 17.32 | 0.044 |
| CPM 18V | 518-363 | 3020° F. | 32.0 | 3.98 | 0.48 | 0.012 | 0.008 | 1.00 | 4.90 | 1.39 | 18.76 | 0.050 |
| CPM 20V | 518-309 | 3020° F. | 32.8 | 4.29 | 0.59 | 0.014 | 0.009 | 1.47 | 4.87 | 1.31 | 19.27 | 0.053 |

*Commercial PM Material

Test materials were prepared from the experimental alloys given in Table I by (1) screening the prealloyed powders to −30 mesh size (U.S. Standard), (2) loading the powder into five-inch diameter by six-inch high mild steel cans, (3) outgassing and sealing the cans, (4) heating the cans to 2165° F. for four hours in a high pressure autoclave operating at about 13.6 ksi, and (5) then slowly cooling them to room temperature. The compacts were then hot forged at a temperature of 2050° F. to bars from which various test specimens were prepared.

Several tests were conducted to demonstrate the advantages of the PM tool steel alloys of the invention for application in cold work tooling. These included (1) microstructure, (2) hardness in the heat treated condition as a measure of strength, (3) Charpy C-notch impact strength as a measure of relative toughness, (4) wear resistance in the pin abrasion and cross-cylinder wear tests as a measure of wear resistance, and (5) grindability.

Figure 1:
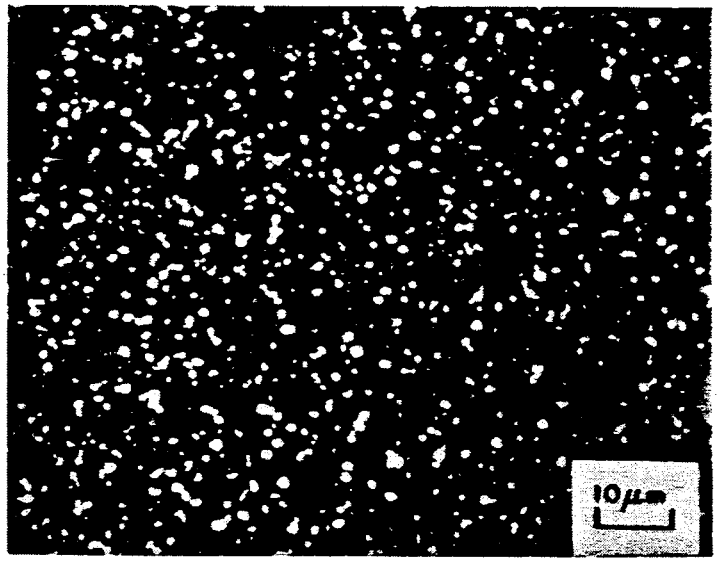
FIG. 1 is a photomicrograph showing MC-type vanadium carbides in a powder-metallurgy cold work tool steel article containing about 10% vanadium (magnification 1000×)
Figure 2A:
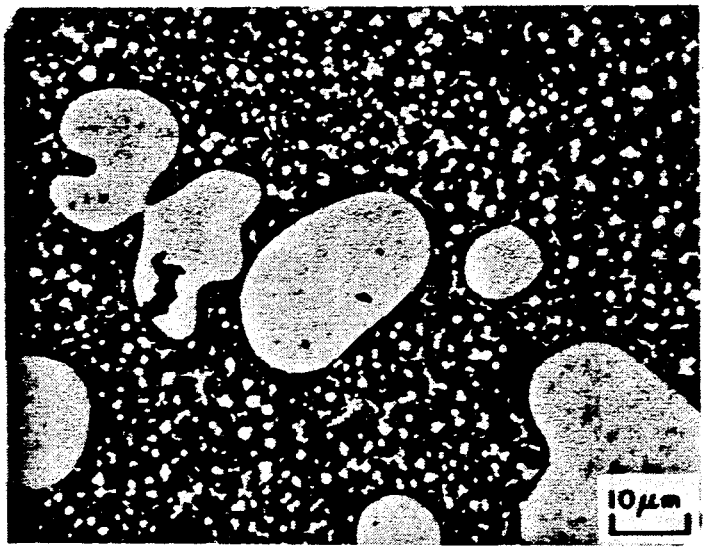
FIG. 2A is a similar photomicrograph showing the MC-type vanadium carbides in an as-atomized powder particle containing about 15% vanadium and produced in accordance with prior-art practice.
Figure 2B:
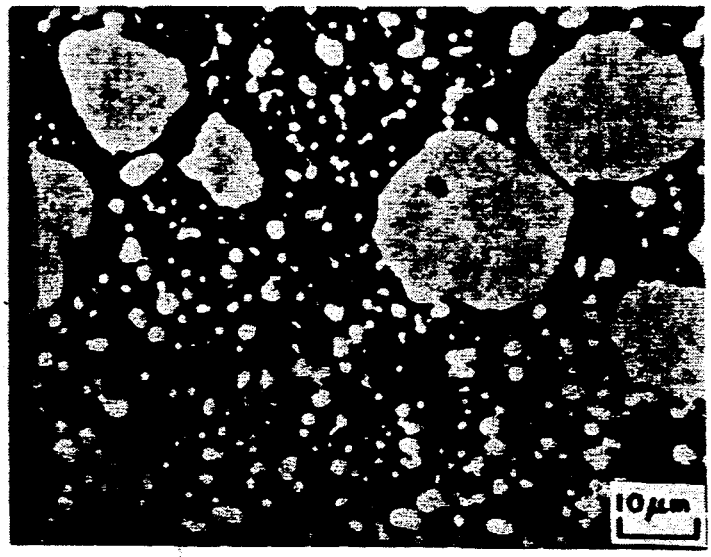
FIG. 2B is a similar photomicrograph of a PM tool steel article made from atomized powder particles from the same heat as the particle of FIG. 2A.
Figure 3A:
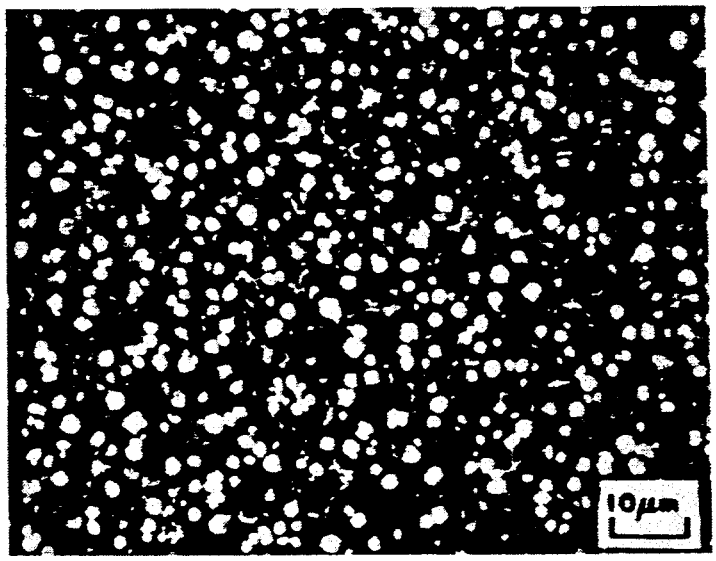
FIG. 3A is a similar photomicrograph showing the MC-type vanadium carbides in an as-atomized powder particle containing about 15% vanadium and produced in accordance with the method of the invention.
Figure 3B:
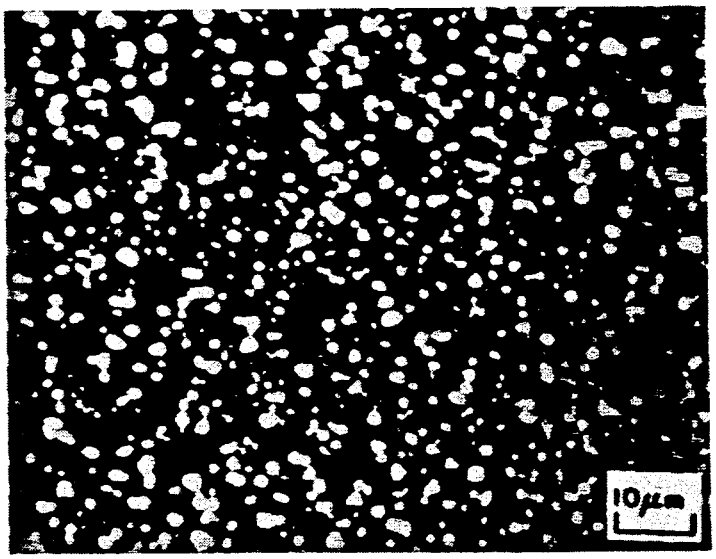
FIG. 3B is a PM article made from powder particles atomized from the same heat as the powder particle of FIG. 3A. The maximum size of the MC-type vanadium carbides in FIGS. 3A and 3B is less than about six microns, as measured in their largest dimension.

The characteristics of the MC-type vanadium carbides present in a PM tool steel articles made from AISI A-11 and in the as-atomized powder particles and PM tool steel articles made from Alloy CPM 15V are illustrated in FIGS. 1, 2, and 3. By use of a special etching technique, the MC-type vanadium carbides in these particles and articles are made to appear in these figures as white particles on a dark background. In FIG. 1, it can be seen that for the commercial All alloy produced in accordance with U.S Pat. No. 4,249,945, the vanadium carbides in the microstructure are small in size, essentially spherical in shape, and well distributed throughout the matrix. FIG. 2 shows the irregular distribution and large sizes of the vanadium carbides in the CPM 15V powder particles and PM articles produced from Heat 516-401 which was nitrogen atomized at a temperature (2910° F.) somewhat higher than that used for atomizing the commercial A-11 material. The presence of these unfavorable carbide characteristics is in agreement with the teaching of U.S. Pat. No. 4,249,945 that indicates PM (powder metallurgy ) tool steel articles of this type that contain 11% or more vanadium have an unfavorable size and non-uniform distribution of vanadium carbides. FIG. 3 shows the improvement in the distribution and size of the MC-type vanadium carbides in a CPM 15V powder particle and CPM 15V tool steel article made from Heat 518-306 that was atomized at a significantly higher temperature (3020° F.) than used with Heat 516-401. This result shows that in opposition to the teaching of U.S. Pat. No. 4,249,945, PM cold work tool steel articles of this type can be produced at high vanadium contents with a substantially uniform distribution of fine vanadium carbides when they are produced from powders atomized at higher than conventional temperatures. The characterization of the substantially uniform carbide distribution in accordance with the invention is evident from a comparison of FIGS. 2 and 3. The maximum size of the largest vanadium carbides in FIG. 2 exceeds 10 microns, while that of the largest carbides in FIG. 3 is about 6 microns. Higher atomization temperatures than indicated in Table I can be used for the atomization of the PM powders and articles of the invention, but they are generally limited to about 3250° F. because of problems with the refractories used in the melting and atomization apparatus. The distribution and size of the MC-type vanadium carbides in the CPM 15V powder and tool steel article made from Heat 518-306 and shown in FIG. 3 are illustrative of those present in the particles and articles of this invention; whereas those in the CPM 15V powder and tool steel article made from Heat 516-401 and shown in FIG. 2 are characteristic of powder and articles outside the scope of the invention.

Hardness can be used as a measure of a tool steel to resist deformation during service in cold work or warm work applications. In general, a minimum hardness of about 56 HRC is needed for tool steels in such applications. However, this does not preclude the use of the product of this invention at lower hardnesses. The results of a hardening and tempering survey conducted on samples of Alloys CPM 15V made from Heat 518-306, CPM 18V made from Heat 518-308, and CPM 20V made from Heat 518-309 are given in Table II and clearly show that the PM tool steel articles of the invention readily achieve a hardness in excess of 56 HRC when austenitized and tempered over a wide range of conditions.

TABLE II

Hardening and Tempering Behavior of Experimental High Vanadium PM Tool Steels

| Grade | Heat | Austenitizing Temp./Time | As Quenched | Hardness - HRC Tempered 2 + 2 Hr at Indicated Temperature 950 F. | 1000 F. | 1025 F. | 1050 F. | 1100 F. |
|---|---|---|---|---|---|---|---|---|
| CPM 15V | 518-306 | 1950 F./1 hr | 66.7 | 64.2 | 62.2 | 62.3 | 62.3 | 52.0 |
| CPM 18V | 516-308 | 1950 F./1 hr | 64.0 | 64.3 | 62.2 | 61.4 | 60.4 | 53.3 |
| CPM 20V | 518-309 | 1950 F./1 hr | 64.3 | 64.5 | 63.4 | 61.6 | 61.0 | 53.0 |
| CPM 15V | 518-306 | 2050 F./30 min | 66.0 | 65.0 | 64.0 | 63.5 | 63.2 | 54.5 |
| CPM 18V | 516-308 | 2050 F./30 min | 65.5 | 65.7 | 63.1 | 62.3 | 61.8 | 55.5 |

TABLE II-continued

Hardening and Tempering Behavior of Experimental High Vanadium PM Tool Steels

| Grade | Heat | Austenitizing Temp./Time | As Quenched | Hardness - HRC Tempered 2 + 2 Hr at Indicated Temperature 950 F. | 1000 F. | 1025 F. | 1050 F. | 1100 F. |
|---|---|---|---|---|---|---|---|---|
| CPM 20V | 518-309 | 2050 F./30 min | 67.0 | 67.0 | 62.0 | 63.2 | 61.2 | 55.4 |
| CPM 15V | 518-306 | 2150 F./10 min | 65.0 | 65.2 | 65.3 | 65.5 | 64.2 | 56.0 |
| CPM 18V | 516-308 | 2150 F./10 min | 65.2 | 66.5 | 64.8 | 63.8 | 63.5 | 57.4 |
| CPM 20V | 518-309 | 2150 F./10 min | 66.3 | 68.0 | 65.8 | 63.1 | 63.3 | 57.1 |

Charpy C-notch impact toughness tests were conducted at room temperature in accordance with the procedure given in ASTM E23-88 on specimens having a notch radius of 0.5 inch. The results obtained for specimens prepared from PM tool articles within the scope of the invention and for two commercial, conventional wear resistant cold work tool steels are given in Table III. The results show that the impact toughness of the PM tool steel articles of the invention decreases with vanadium content and that the best toughness is achieved for those articles containing less than about 16% vanadium. They also show that depending upon vanadium content and heat treatment, the toughness of the PM tool steel articles of the invention is comparable to that of two widely used conventional ingot cast cold work tool steels, which as shown in Table IV, have substantially poorer wear resistance.

TABLE III

Charpy C-notch Impact Toughness of Experimental High Vanadium PM Tool Steels

| Grade | Heat | Vanadium Content % | Heat Treatment** | Hardness HRC | Charpy C-notch Impact Energy (ft-lb) |
|---|---|---|---|---|---|
| AISI D4* | — | — | A | 61.0 | 10 |
| AISI D7* | — | 4.00 | B | 60.0 | 7 |
| CPM 15V | 518-277 | 15.21 | C | 64.5 | 8 |
| CPM 18V | 518-308 | 17.32 | C | 63.0 | 4 |
| CPM 20V | 518-309 | 19.27 | C | 63.0 | 3 |
| CPM 15V | 518-277 | 15.21 | D | 63.0 | 9 |
| CPM 18V | 518-308 | 17.32 | D | 63.0 | 4 |
| CPM 20V | 518-309 | 19.27 | D | 65.5 | 4 |

*Commercial ingot cast material
**A - 1850° F./OQ/500° F. 2 + 2 hrs
B - 1900° F./OQ/400° F. 2 + 2 hrs
C - 2150° F./OQ/1025° F. 2 + 2 + 2 hrs
D - 2050° F./OQ/1025° F. 2 + 2 hrs

TABLE IV

Wear Resistance of Experimental High Vanadium Wear Resistant PM Tool Steels

| Grade | Heat | Vanadium Content % | Heat Treatment** | Hardness HRC | Pin Abrasion Test Weight Loss (Mg) | Crossed Cylinder Wear Resistance ($10^{10}$ psi) |
|---|---|---|---|---|---|---|
| D-7* | — | 4.00 | — | 61 | — | 7 |
| A-11** | P67216 | 9.85 | A | 64 | 32.2 | 45 |
| CPM 15V | 518-306 | 15.91 | B | 64 | 23.7 | 77 |
| CPM 18V | 518-308 | 17.32 | B | 63 | 22.7 | 124 |
| CPM 20V | 518-309 | 19.27 | B | 63 | 16.8 | 110 |

*Commercial ingot cast material
**Commercial PM material
***A - 2150° F./10 min, oil quench, temper 1000° F. 2 + 2 + 2 hr.
B - 2150° F./10 min, oil quench, temper 1025° F. 2 + 2 + 2 hr.

Two tests were conducted to compare the wear resistance of the PM tool steel articles of the invention to some widely used, highly wear resistant cold work tooling materials. The pin abrasion wear test was used to evaluate their abrasion resistance. In this test, a 0.250-inch diameter specimen is pressed against 150-mesh garnet abrasive cloth under a load of 15 pounds. The cloth is attached to a movable table which causes the specimen to move about 500 inches in a nonoverlapping path over fresh abrasive. As the specimen travels over the abrasive, it is rotated around its own axis. The relative wear resistance is rated by the weight loss of the specimen. The results of the test have correlated well with those obtained in service under abrasive wear conditions.

The cross cylinder wear test was used to compare the resistance of the experimental articles to adhesive wear. In this test, a cylindrical specimen of the tool steel to be tested and a cylindrical specimen of tungsten carbide are positioned perpendicularly to each other. A fifteen-pound load is applied to the specimens through a weight on a lever arm. Then the tungsten carbide cylinder specimen is rotated at a speed of 667 revolutions per minute. No lubrication is applied. As the test progresses, a wear spot develops on the specimen of tool steel. At the end of the test, the extent of wear is determined by measuring the depth of the wear spot on the specimen and converting it into wear volume by aid of a relationship derived for this purpose. The wear resistance, or the reciprocal of the wear rate, is then computed by the following formula:

$$\text{Wear Resistance} = \frac{1}{\text{Wear Rate}} = \frac{L\Delta s}{\Delta v} = \frac{L\pi d\Delta N}{\Delta v}$$

where:

v=the wear volume ($in^3$)

L=the applied load (lb

)

s=the sliding distance (in)

d=the diameter of the tungsten carbide cylinder (in) and

N=the number of revolutions made by the tungsten carbide cylinder (rpm)

The results of the wear tests are given in Table IV. It is clear that under both abrasive and adhesive wear conditions that the PM tool steel articles of the invention outperform All, which is a highly wear resistant PM tool steel produced in accord with U.S. Pat. No. 4,249,945, and D-7, which is a highly wear resistant conventional ingot-cast cold-work tool steel. The results also show that the wear resistance of the PM tool steel articles of the invention generally increases with their vanadium content.

An essential finding in accordance with the invention is that improved grindability can be obtained with highly wear resistant PM tool steel articles containing more than about 11% vanadium by producing them for prealloyed powders that have been gas atomized from higher than normal temperatures. To demonstrate this, grindability tests were conducted on samples of two of the PM tool steel alloys given in Table I that have similar compositions within the scope of the invention, but which were made from prealloyed powders atomized from different superheating temperatures.

The grindability tests were conducted on a Landis Universal Type CH cylindrical traversing grinder. For these tests, cylindrical test specimens are heat treated to the high hardness at which they will be applied in service and then the surface is ground to remove at least 0.050 inch from the diameter to eliminate the surface deterioration effects of heat treatment.

The grinding conditions used for the tests were as follows:

Grinding Wheel—Norton 57A60-1L5VBE
Grinding Wheel Speed—1740 rpm
Specimen Rotational Speed—110 rpm
Traversing Speed—0.250 inch/sec
In Feed—0.001 inch/pass
Coolant—Prine Cut diluted 30:1

Before each test, the diameter of the test specimen is carefully measured with a micrometer and the diameter of the grinding wheel is determined by carefully measuring its circumference with a Pi-based measuring tape and mathematically calculating it. The width of the grinding wheel is measured with a micrometer. In this grindability test, both the grinding wheel and the cylindrical test specimen rotate, but in opposite directions to each other. The test is conducted by traverse grinding from right to left in an excess of coolant with a grinding wheel infeed of 0.001 inch per pass. At various intervals, the grinding wheel and test specimen diameters are determined and the test is concluded when the sum of the reduction in grinding wheel diameter plus the reduction in test specimen diameter equals 0.020 inch. The volume of grinding wheel wear and the volume of specimen (metal) removal are calculated from the diameter and wheel width measurements and a grindability index is calculated from the relation.

$$\text{Grindability Index} = \frac{\text{Volume of Metal Removed}}{\text{Volume of Grinding Wheel Wear}}$$

A high grindability index is preferred.

Using the above procedure, a grindability comparison was made for PM articles made from Alloy 15V produced with undesirable large carbide contents and with the favorable, small carbide contents in accordance with this invention. As the values in Table V show, the grindability of the alloy of this invention (Heat 518-306) containing vanadium carbides with a maximum size of about 6 microns is double that of the nearly equivalent composition (Heat 516-401) containing much larger carbides with sizes exceeding 10 microns. The grindability of the alloys of the invention generally improves as the maximum size of the MC-type vanadium carbides decreases below about 6 microns and is preferably kept below about 4 microns for best grindability.

All percentages as reported herein, unless indicated otherwise, are in percent by weight.

Gas atomization as used herein is a practice wherein a molten alloy stream is contacted with a gas jet, generally of a gas such as nitrogen or argon, to break up the molten alloy stream into droplets which are then rapidly cooled and solidified to form prealloyed particles.

Gas atomized particles as used herein refer to spherical particles inherently resulting from gas atomization, as opposed to angular particles as produced by water atomization or comminution of an alloy ingot.

Powder-metallurgy produced articles, as used herein, refer to consolidated articles having a density greater than 99% of theoretical density produced from prealloyed particles.

The term cold work tool steels as used herein includes warm and cold work tool and die steels and excludes high speed steels of the type used in high speed cutting applications.

The term MC-type vanadium carbides as used herein refers to carbides characterized by a face-centered cubic crystal structure wherein "M" represents the carbide forming element vanadium, and small amounts of other elements, such as molybdenum or chromium that may be present in the carbide; the term also includes the $M_4C_3$- type vanadium carbides and variations thereof known as carbonitrides wherein some of the carbon is replaced by nitrogen.

Aluminum is commonly used in the manufacture of ferrovanadium to reduce vanadium oxide. Consequently, the aluminum contents of commercial ferrovanadium can be as high as 2.50%. Use of such aluminum-bearing ferrovanadium in the production of the high vanadium tool steels described in the subject invention can introduce as much as 0.60% aluminum, depending on the methods used to melt or refine these steels. It is not expected that residual aluminum contents as high as 0.60% would have an adverse effect on the properties of the high vanadium PM cold work tool steels of the invention. However, if it is determined that specific residual aluminum levels are detrimental in some applications for these steels, conventional mea-

TABLE V

Grindability of Experimental High Vanadium Wear Resistant PM Tool Steels

| Grade | Heat | Vanadium Content (%) | Superheating Temperature | Carbide* Size | Hardness** HRC | Grindability*** Index |
|---|---|---|---|---|---|---|
| CPM 15V | 518-306 | 15.91 | 3020° F. | S | 62 | 1.5 |
| CPM 15V | 516-401 | 14.76 | 2910° F. | L | 62 | 0.7 |

*S-maximum carbide size about 6 microns; L-maximum carbide size above about 10 microns
**Specimens austenitized at 2050° F. for 30 minutes, oil quenched, tempered at 1025° F. for 2 + 2 hour
***Grindability Index = $\frac{\text{Volume of Metal Removed}}{\text{Volume of Grinding Wheel Wear}}$ sures can be taken in the production of the steels of the invention to reduce the residual aluminum content to acceptable levels for a particular application.

The term "substantially entirely" as used herein means that there may be isolated MC-type vanadium carbides present exceeding the claimed maximum carbide size without adversely affecting the beneficial properties of the alloy, namely grindability and toughness.

We claim:

1. A method for producing prealloyed cold work tool steep particles for use in the powder-metallurgy production of tool steel articles, said method comprising atomizing a molten tool steel alloy at a temperature above 2910° F. and rapidly cooling said atomized alloy to form said particles, with said particles having an MC vanadium carbide dispersion therein of a carbide particle size substantially entirely less than 6 microns and in an amount of 18.5 to 34.0% by volume, wherein a grindability index, as defined herein, above about 0.7 is achieved.

2. The method of claim 1 wherein said temperature is above 2910° F. to about 3250° F.

3. The method of claim 1 wherein said temperature is above 2910° F. to about 3020° F.

4. The method of claim 1 wherein said temperature is about 2950° F. to about 3250° F.

5. The method of claims 1, 2, 3, or 4, wherein said carbide particle size is substantially entirely less than 4 microns.

6. The method of claims 1, 2, 3, or 4, wherein said atomizing is gas atomization.

7. The method of claim 1 wherein said cold work tool steel alloy consists essentially of, in weight percent, 2.6 to 4.70 carbon, up to 0.15 nitrogen, 0.2 to 2.0 manganese, up to 2.0 silicon, 1.5 to 6.0 chromium, up to 6.0 molybdenum, up to 0.30 sulfur, 11.5 to 20.0 vanadium and balance iron and incidental impurities, wherein the carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

8. The method of claim 1 wherein said cold work tool steel alloy consists essentially of, in weight percent, 2.7 to 4.30 carbon, up to 0.15 nitrogen, 0.2 to 1.0 manganese, up to 2.0 silicon, 4.0 to 6.0 chromium, 0.5 to 2.0 molybdenum, up to 0.10 sulfur, 12.0 to 18.0 vanadium and balance iron and incidental impurities, wherein carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

9. The method of claim 1 wherein said cold work tool steel alloy consists essentially of, in weight percent, 2.7 to 3.90 carbon, up to 0.15 nitrogen, 0.2 to 1.0 manganese, up to 2.0 silicon, 4.5 to 5.5 chromium, 0.5 to 2.0 molybdenum, up to 0.10 sulfur, 12.0 to 16.0 vanadium and balance iron and incidental impurities, wherein carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

10. The method of claim 2 wherein said cold work tool steel alloy consists essentially of, in weight percent, 2.6 to 4.70 carbon, up to 0.15 nitrogen, 0.2 to 2.0 manganese, up to 2.0 silicon, 1.5 to 6.0 chromium, up to 6.0 molybdenum, up to 0.30 sulfur, 11.5 to 20.0 vanadium and balance iron and incidental impurities, wherein the carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

11. The method of claim 2 wherein said cold work tool steel alloy consists essentially of, in weight percent, 2.7 to 4.30 carbon, up to 0.15 nitrogen, 0.2 to 1.0 manganese, up to 2.0 silicon, 4.0 to 6.0 chromium, 0.5 to 2.0 molybdenum, up to 0.10 sulfur, 12.0 to 18.0 vanadium and balance iron and incidental impurities, wherein carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

12. The method of claim 3 wherein said cold work tool steel alloy consists essentially of, in weight percent, 2.7 to 3.90 carbon, up to 0.15 nitrogen, 0.2 to 1.0 manganese, up to 2.0 silicon, 4.5 to 5.5 chromium, 0.5 to 2.0 molybdenum, up to 0.10 sulfur, 12.0 to 16.0 vanadium and balance iron and incidental impurities, wherein carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

13. The method of claim 3 wherein said cold work tool steel alloy consists essentially of, in weight percent, 2.6 to 4.70 carbon, up to 0.15 nitrogen, 0.2 to 2.0 manganese, up to 2.0 silicon, 1.5 to 6.0 chromium, up to 6.0 molybdenum, up to 0.30 sulfur, 11.5 to 20.0 vanadium and balance iron and incidental impurities, wherein the carbon and nitrogen are $$\text{percent } (C+N)_{minimum}=0.30+0.20\ (\%\ V)$$

$$\text{percent } (C+N)_{maximum}=0.70+0.20\ (\%\ V).$$

14. The method of claim 3 wherein said cold work tool steel alloy consists essentially of, in weight percent, 2.7 to 4.30 carbon, up to 0.15 nitrogen, 0.2 to 1.0 manganese, up to 2.0 silicon, 4.0 to 6.0 chromium, 0.5 to 2.0 molybdenum, up to 0.10 sulfur, 12.0 to 18.0 vanadium and balance iron and incidental impurities, wherein carbon and nitrogen are balanced according to the formulas, $$\text{percent } (C+N)_{minimum}=0.30+0.20\ (\%\ V)$$

$$\text{percent } (C+N)_{maximum}=0.70+0.20\ (\%\ V).$$

15. The method of claim 3 wherein said cold work tool steel alloy consists essentially of, in weight percent, 2.7 to 3.90 carbon, up to 0.15 nitrogen, 0.2 to 1.0 manganese, up to 2.0 silicon, 4.5 to 5.5 chromium, 0.5 to 2.0 molybdenum, up to 0.10 sulfur, 12.0 to 16.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

16. The method of claim 4 wherein said cold work tool steel alloy consists essentially of, in weight percent, 2.6 to 4.70 carbon, up to 0.15 nitrogen, 0.2 to 2.0 manganese, up to 2.0 silicon, 1.5 to 6.0 chromium, up to 6.0 molybdenum, up to 0.30 sulfur, 11.5 to 20.0 vanadium and balance iron and incidental impurities, wherein the carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

17. The method of claim 4 wherein said cold work tool steel alloy consists essentially of, in weight percent, 2.7 to 4.30 carbon, up to 0.15 nitrogen, 0.2 to 1.0 manganese, up to 2.0 silicon, 4.0 to 6.0 chromium, 0.5 to 2.0 molybdenum, up to 0.10 sulfur, 12.0 to 18.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

18. The method of claim 4 wherein said cold work tool steel alloy consists essentially of, in weight percent, 2.7 to 3.90 carbon, up to 0.15 nitrogen, 0.2 to 1.0 manganese, up to 2.0 silicon, 4.5 to 5.5 chromium, 0.5 to 2.0 molybdenum, up to 0.10 sulfur, 12.0 to 16.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

19. The method of claim 5 wherein said cold work tool steel alloy consists essentially of, in weight percent, 2.6 to 3.90 carbon, up to 0.15 nitrogen, 0.2 to 2.0 manganese, up to 2.0 silicon, 1.5 to 6.0 chromium, up to 6.0 molybdenum, up to 0.30 sulfur, 11.5 to 20.0 vanadium and balance iron and incidental impurities, wherein the carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

20. The method of claim 5 wherein said cold work tool steel alloy consists essentially of, in weight percent, 2.7 to 4.30 carbon, up to 0.15 nitrogen, 0.2 to 1.0 manganese, up to 2.0 silicon, 4.0 to 6.0 chromium, 0.5 to 2.0 molybdenum, up to 0.10 sulfur, 12.0 to 18.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

21. The method of claim 3 wherein said cold work tool steel alloy consists essentially of, in weight percent, 2.7 to 3.90 carbon, up to 0.15 nitrogen, 0.2 to 1.0 manganese, up to 2.0 silicon, 4.5 to 5.5 chromium, 0.5 to 2.0 molybdenum, up to 0.10 sulfur, 12.0 to 16.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

22. The method of claim said cold work tool steel alloy consists essentially of, in weight percent, 2 6 to 4.70 carbon, up to 0.15 nitrogen, 0.2 to 2.0 manganese, up to 2.0 silicon, 1.5 to 6.0 chromium, up to 6.0 molybdenum, up to 0.30 sulfur, 11.5 to 20.0 vanadium and balance iron and incidental impurities, wherein the carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

23. The method of claim 6 wherein said cold work tool steel alloy consists essentially of, in weight percent, 2.7 to 4.30 carbon, up to 0.15 nitrogen, 0.2 to 1.0 manganese, up to 2.0 silicon, 4.0 to 6.0 chromium, 0.5 to 2.0 molybdenum, up to 0.10 sulfur, 12.0 to 18.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

24. The method of claim 6 wherein said cold work tool steel alloy consists essentially of, in weight percent, 2.7 to 3.90 carbon, up to 0.15 nitrogen, 0.2 to 1.0 manganese, up to 2.0 silicon, 4.5 to 5.5 chromium, 0.5 to 2.0 molybdenum, up to 0.10 sulfur, 12.0 to 16.0 vanadium and balance iron and incidental impurities, wherein carbon and nitrogen are balanced according to the formulas, $$percent\ (C+N)_{minimum}=0.30+0.20\ (\%\ V)$$

$$percent\ (C+N)_{maximum}=0.70+0.20\ (\%\ V).$$

* * * * *

UNITED STATES PATENT AND TRADEMARK OFFICE

CERTIFICATE OF CORRECTION

PATENT NO. : 5,238,482

DATED : August 24, 1993

INVENTOR(S) : William STASKO et al.

It is certified that error appears in the above-indentified patent and that said Letters Patent is hereby corrected as shown below:

Title page, item [54], and col. line 2, line 3, change "METHODS" to --METHOD--.

Claim 1, column 11, line 11, change "steep" to --steel--.

Claim 12, column 12, line 28, change "claim 3" to --claim 2--.

Claim 13, column 12, line 47, after "are" insert --balanced according to the formulas,--.

Claim 21, column 14, line 11, change "claim 3" to --claim 5--.

Claim 22, column 14, line 24, after "claim" insert --6--.

Claim 22, column 14, line 25, change "26" to --2.6--.

Signed and Sealed this

Nineteenth Day of April, 1994

Bruce Lehman

*Attest:*

BRUCE LEHMAN

*Attesting Officer*

*Commissioner of Patents and Trademarks*